US008926067B2

(12) United States Patent
Iwanaga et al.

(10) Patent No.: US 8,926,067 B2
(45) Date of Patent: Jan. 6, 2015

(54) LIQUID DISCHARGING RECORDING HEAD

(71) Applicant: Canon Kabushiki Kaisha, Tokyo (JP)

(72) Inventors: Shuzo Iwanaga, Kawasaki (JP); Kazuhiro Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/763,344

(22) Filed: Feb. 8, 2013

(65) Prior Publication Data

US 2013/0208053 A1 Aug. 15, 2013

(30) Foreign Application Priority Data

Feb. 13, 2012 (JP) ..... 2012-028792

(51) Int. Cl.
*B41J 2/05* (2006.01)
*B41J 2/14* (2006.01)

(52) U.S. Cl.
CPC ..... *B41J 2/14427* (2013.01); *B41J 2/1408* (2013.01); *B41J 2/14145* (2013.01); *B41J 2202/20* (2013.01)
USPC ..... 347/61; 347/63

(58) Field of Classification Search
USPC ..... 347/61, 63
See application file for complete search history.

(56) References Cited

U.S. PATENT DOCUMENTS

2002/0138564 A1 9/2002 Treptow
2008/0317942 A1* 12/2008 Harada et al. ..... 427/58
2012/0033017 A1* 2/2012 Iwanaga et al. ..... 347/54

FOREIGN PATENT DOCUMENTS

CN 101005550 A 7/2007
CN 101207694 A 6/2008
JP 2006-056240 A 3/2006
JP 2008-194940 A 8/2008
JP 2009-101578 A 5/2009
JP 2009-149056 A 7/2009
JP 2010-221660 A 10/2010

OTHER PUBLICATIONS

Wikipedia Article—Aluminum Oxide, Section: Properties Wikipedia Article—Thermal Conductivity, Section: Resistance Efunda Page—Epoxy, Section: Material Properties Efunda Page—Silicone, Section: Material Properties.*

* cited by examiner

*Primary Examiner* — Lisa M Solomon
(74) *Attorney, Agent, or Firm* — Canon USA Inc IP Division

(57) ABSTRACT

A liquid discharging recording head includes an element substrate including a plurality of discharge ports configured to discharge liquid and a plurality of energy generating elements configured to generate energy for discharging the liquid, a support member configured to support the element substrate, a first member configured to support an end of the element substrate in an array direction in which the discharge ports are arrayed, the first member having a thermal conductivity lower than a thermal conductivity of the support member, and a second member configured to support an end of the element substrate in an intersecting direction intersecting the array direction, the second member having a thermal conductivity lower than the thermal conductivity of the support member and a thermal resistance lower than a thermal resistance of the first member.

9 Claims, 5 Drawing Sheets

LIQUID DISCHARGING RECORDING HEAD

BACKGROUND OF THE INVENTION

1. Field of the Invention

The present disclosure relates to a liquid discharging recording head that discharges liquid.

2. Description of the Related Art

In a liquid discharging recording apparatus that performs recording by discharging liquid such as ink, a liquid discharging recording head is mounted. The liquid discharging recording head includes a recording element substrate (element substrate) having discharge ports. The liquid discharging recording apparatus performs image recording by discharging liquid supplied to the recording element substrate from the discharge ports so that the liquid is attached onto a recording medium.

In recent years, recording speed has been increased by increasing the length and number of discharge port arrays provided in one recording element substrate or arranging a plurality of recording element substrates in a discharge port array direction on a liquid discharge recording head.

Such a liquid discharge recording head is disclosed in Japanese Patent Laid-Open No. 2009-101578. FIG. 5A illustrates a full-line liquid discharging recording head in which recording element substrates H1100 (H1100*a* to H1100*f*), each having a plurality of discharge port arrays H1106, are arranged in a staggered manner in a discharge port array direction on a support plate H1200 to form discharge port arrays corresponding to the width of a recording medium.

FIG. 5B is a partial cross-sectional view of the liquid discharging recording head, taken along line VB-VB of FIG. 5A. Liquid supplied from an un-illustrated liquid storage tank flows through liquid supply passages H1201*a* to H1201*d* provided in the support plate H1200, and are then supplied to liquid supply ports H1101*a* to H1101*d* of the corresponding recording element substrates H1100.

When a pulse signal is transmitted from a liquid discharging recording apparatus body to heaters (recording elements) on the recording element substrates H1100, heat energy is applied to discharge the liquid from the discharge ports, whereby image recording is performed. Heat generated in the recording element substrates H1100 during recording is radiated outside via the support plate H1200.

In the liquid discharging recording head described in Japanese Patent Laid-Open No. 2009-101578, the temperature tends to become lower in an outer peripheral portion of each recording element substrate H1100 than in a center portion, and the in-plane temperature distribution of the recording element substrate H1100 is non-uniform.

The reason why such a phenomenon occurs can be explained by the difference of the heat transfer passage between the center portion and the outer peripheral portion of the recording element substrate H1100.

First, heat transfer in the center portion will be described. For example, heat generated by the heaters provided in the recording element substrate H1100 is diffused between the liquid supply ports H1101*a* and H1101*b*, and is further transferred to a portion of the support plate H1200 between the liquid supply ports H1201*a* and H1201*b* (FIG. 5B). While the liquid supply passages H1201 are in contact with the liquid, the thermal conductivity of a liquid is much lower than that of a solid, and therefore, heat is rarely transferred to the liquid. The heat is transferred in the discharge port array direction in the support plate H1200 and is finally diffused out of the support plate H1200 through a long transfer passage.

In contrast, in the outer peripheral portion, heat is diffused from ends of the recording element substrate H1100 to an outer side of the support plate H1200 without being blocked by the liquid supply passages H1201. For this reason, the temperature becomes lower in the outer peripheral portion than in the center portion of the recording element substrate H1100, and this causes unevenness in temperature in the plane of the recording element substrate H1100.

In general, the amount of discharged liquid increases as the temperature of the recording element substrate increases. Hence, if the unevenness in temperature occurs in the plane of the recording element substrate, the amount of discharged liquid also becomes uneven. This causes unevenness in density of a recorded image, and deteriorates image quality. Particularly when input heat energy per unit time is increased for high-speed image recording, the unevenness in temperature in the plane of the recording element substrate increases further.

In contrast, in a liquid discharging recording head described in Japanese Patent Laid-Open No. 2008-194940, resistors are provided around portions on a support plate where recording element substrates are mounted. The temperature of each recording element substrate is controlled by applying a signal from a liquid discharging recording apparatus to the corresponding resistor so as to appropriately generate heat in the resistor while monitoring a temperature sensor provided on the recording element substrate. Since the liquid discharging recording head of Japanese Patent Laid-Open No. 2008-194940 adopts this structure, an outer peripheral portion of the recording element substrate can be heated.

However, since the in-plane temperature distribution of each recording element substrate is not uniform in a direction intersecting a direction of discharge port arrays of the recording element substrate, even if the outer peripheral portion of the recording element substrate is uniformly heated, the in-plane unevenness in temperature of the recording element substrate is not reduced.

Specifically, the fall in temperature from the temperature in the center portion is larger at both ends (outer peripheral portion) of the recording element substrate in a direction of the discharge port arrays (a direction parallel to the discharge port arrays) than at both ends of the recording element substrate in the direction intersecting the discharge port arrays (a direction perpendicular to the discharge port arrays). For this reason, if the temperature distribution in the direction of the discharge port arrays is made uniform, the temperature excessively increases at both ends in the direction intersecting the discharge port arrays, and as a result, the in-plane unevenness in temperature of the recording element substrate is not reduced.

Such a difference in temperature distribution in both the directions is considered to be caused by the difference in distance from the outermost recording element to the end of the recording element substrate between the directions and the influence of arrangement of the recording element. However, it is difficult to adjust the distance and arrangement, because of restrictions on a circuit of the recording element substrate.

SUMMARY OF THE INVENTION

The present disclosure provides a liquid discharging recording head that can reduce in-plane unevenness in temperature of a recording element substrate and can record a high-quality image with reduced unevenness in density.

A liquid discharging recording head according to an aspect disclosed herein includes: an element substrate including a plurality of discharge ports configured to discharge liquid and a plurality of energy generating elements provided to correspond to the plurality of discharge ports to generate energy for discharging the liquid; a support member configured to support the element substrate; a first member configured to support an end of the element substrate in an array direction in which the discharge ports are arrayed, the first member having a thermal conductivity less than a thermal conductivity of the support member; and a second member configured to support an end of the element substrate in an intersecting direction, which intersects the array direction, the second member having a thermal conductivity less than the thermal conductivity of the support member and a thermal resistance less than a thermal resistance of the first member.

Further features of the present disclosure will become apparent from the following description of exemplary embodiments with reference to the attached drawings.

DESCRIPTION OF THE EMBODIMENTS

First Embodiment

Figure 1A:
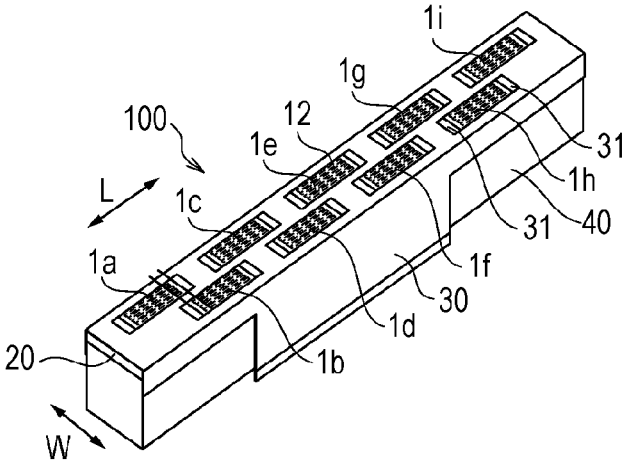
FIG. 1A is a schematic perspective view of a liquid discharging recording head according to a first embodiment.
Figure 1B:
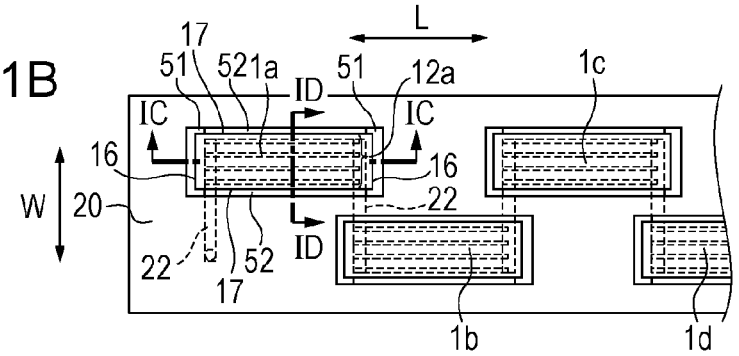
FIG. 1B is a schematic plan view of the liquid discharging recording head illustrated in FIG. 1A, as viewed from a mount surface for recording element substrates.
Figure 1C:
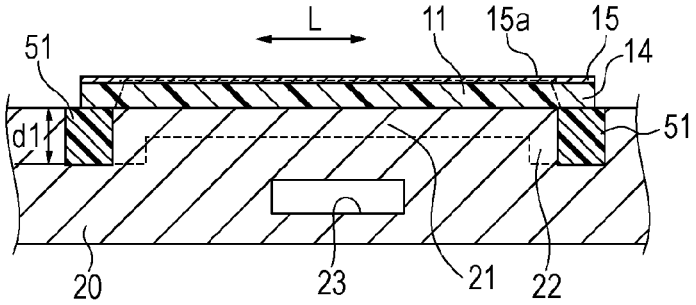
FIG. 1C is a schematic cross-sectional view of the liquid discharging recording head, taken along line IC-IC of FIG. 1B.
Figure 1D:
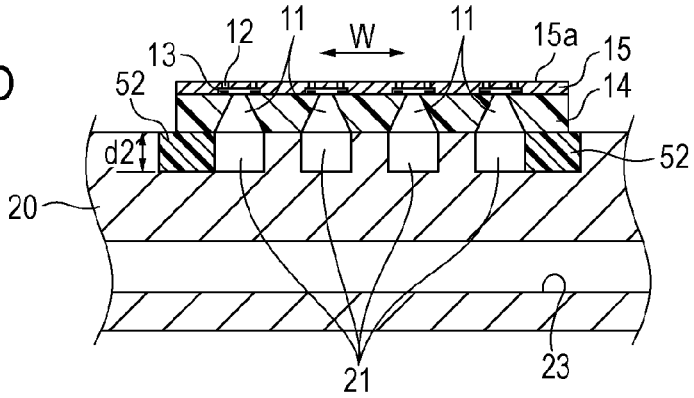
FIG. 1D is a schematic cross-sectional view of the liquid discharging recording head, taken along line ID-ID of FIG. 1B.

FIG. 1A is a schematic perspective view of a liquid discharging recording head 100 according to a first embodiment disclosed herein. FIG. 1B is a schematic plan view of the liquid discharging recording head 100 of FIG. 1A, as viewed from a mount surface for recording element substrates 1. FIG. 1C is a schematic cross-sectional view of the liquid discharging recording head 100, taken along line IC-IC of FIG. 1B, and FIG. 1D is a schematic cross-sectional view of the liquid discharging recording head 100, taken along line ID-ID of FIG. 1B. For explanation of the first embodiment, an electric wiring board 30 and resin materials 31 described below are not illustrated in FIGS. 1B to 1D.

The liquid discharging recording head 100 according to the first embodiment includes a plurality of recording element substrates 1, a support plate 20 (support member), an electric wiring board 30, and a liquid supply member 40.

Each recording element substrate 1 includes recording elements 13 (FIG. 1D) serving as energy generating elements that generate energy for discharging liquid such as ink, and a plurality of discharge ports 12 corresponding to the recording elements 13. A plurality of discharge ports 12 are arrayed to form a discharge port array 12*a*, and a plurality of discharge port arrays 12*a* are provided in one recording element substrate 1 (FIG. 1B). In the first embodiment, electrothermal transducers, such as heaters, are used as the recording elements 13. In the liquid discharging recording head 100 of the first embodiment, supplied liquid is discharged from the discharge ports 12 by heating the liquid by the electrothermal transducers to form bubbles.

The electric wiring board 30 is provided to apply external electric drive signals to the recording element substrates 1. The electric wiring board 30 is electrically connected to the recording element substrates 1 by unillustrated electric connecting members. The electric connecting members are coated with resin materials 31 for protection against external shock.

The support plate 20 includes liquid supply passages 21 (FIG. 1C) through which liquid is introduced into the recording element substrates 1, and supports and fixes the recording element substrates 1 and the electric wiring board 30. Liquid is supplied to the liquid supply member 40 through tubes or the like from an unillustrated recording apparatus body, and is supplied to the recording element substrates 1 through the liquid supply passages 21 in the support plate 20.

The recording element substrates 1 are arranged on the support plate 20 in a staggered manner in an array direction of the discharge ports 12, that is, in a direction of the discharge port arrays 12*a*, thereby forming a full-line liquid discharging recording head 100. In the full-line liquid discharging recording head 100, the discharge ports 12 for discharging liquid are arranged correspondingly to the overall width of a recording medium. The liquid discharging recording head 100 of the first embodiment includes nine recording element substrates 1 (1*a* to 1*i*), and has a total recording width of about 4 to 6 inches. By increasing the number of recording element substrates 1, the recording width can be increased further. When a recording medium conveyed in a W-direction of FIG. 1A by an unillustrated conveying unit passes immediately below the liquid discharging recording head 100, liquid droplets are discharged from the discharge port arrays 12*a* of the recording element substrates 1*a*, 1*c*, 1*e*, 1*g*, and 1*i* and are attached to the recording medium. To fill gaps between the attached liquid droplets, liquid droplets are then discharged from the discharge port arrays 12*a* of the recording element substrates 1*b*, 1*d*, 1*f*, and 1*h* provided between the recording element substrates 1*a*, 1*c*, 1*e*, 1*g*, and 1*i*, and are attached to the recording medium. These operations are repeated to record an image.

Next, the first embodiment will be described in more detail with reference to FIGS. 1B to 1D.

As illustrated in FIGS. 1C and 1D, in each recording element substrate 1, for example, a discharge port plate 15 is provided on a silicon substrate 14 having a thickness of 0.2 to 1.0 mm. The silicon substrate 14 includes liquid supply ports 11 formed by long through grooves. The silicon substrate 14 further includes recording element arrays in which the recording elements 13 are arrayed, and one recording element array is provided on each side of each of the liquid supply ports 11. In a discharge port surface 15*a* of the discharge port plate 15, the discharge ports 12 are provided at positions opposing the corresponding recording elements 13. In the first embodiment, one recording element substrate 1 includes four liquid supply ports 11, eight recording element arrays, and eight discharge port arrays 12*a*.

For example, the support plate 20 is formed of silicon carbide (SiC) and has a thickness of 0.5 to 10 mm. Silicon carbide is effective in radiating heat generated in the recording elements 13 because of its excellent mechanical property and high thermal conductivity. The material of the support plate 20 is not limited to silicon carbide, and may be selected from other materials. Depending on the required performance, for example, less expensive aluminum oxide ($Al_2O_3$) may be used.

The support plate 20 includes liquid supply passages 21 corresponding to the liquid supply ports 11 of the recording element substrates 1. Further, the support plate 20 includes liquid connecting passages 22 that connect the liquid supply passages 21 between the recording element substrates 1 located at adjacent positions on the support plate 20 (FIG. 1B). The liquid connecting passages 22 provided on outer sides of the recording element substrates 1*a* and 1*i* provided at opposite ends of the liquid discharging recording head 100, of the recording element substrates 1, are connected to the liquid supply member 40. A cooling passage 23 is provided in the support plate 20. By causing cooling water or the like to flow through the cooling passage 23, heat radiation performance of the liquid discharging recording head 100 is enhanced.

The flow of liquid supplied to the liquid discharging recording head 100 will now be described. Liquid supplied from the liquid discharging recording apparatus body is supplied via the liquid supply member 40 to the liquid connecting passage 22 provided on the left side of the recording element substrate 1*a* in FIG. 1B. Subsequently, the liquid passes through the liquid supply passages 21 and the liquid supply ports 11 in order, is supplied onto the recording elements 13 of the recording element substrate 1*a*, and is discharged from the discharge ports 12. Part of the liquid supplied to the liquid supply passages 21 flows to the liquid connecting passage 22 on the right side of the recording element substrate 1*a* in FIG. 1B, and is similarly supplied to the recording element substrate 1*b* adjacent to the recording element substrate 1*a*. By repeating these operations, the liquid is supplied to the recording element substrates 1*a* to 1*i*.

Next, a characteristic part of the first embodiment will be described. While the recording element substrates 1 are mounted on the support plate 20, as illustrated in FIG. 1B, other members are provided between outer peripheral portions of the recording element substrates 1 and the support plate 20. First members 51 are provided immediately below sides 16 of an outer peripheral portion of each recording element substrate 1 extending in a direction intersecting the array direction of the discharge ports 12 (a direction perpendicular to the array direction in the first embodiment), that is, in a W-direction of FIG. 1B. Second members 52 are provided immediately below sides 17 of the recording element substrate 1 extending in a direction along the array direction of the discharge ports 12 (a direction parallel to the array direction in the first embodiment), that is, in an L-direction of FIG. 1B. That is, the first members 51 support opposite ends of the recording element substrate 1 in the L-direction, and the second members 52 support opposite ends of the recording element substrate 1 in the W-direction.

The thermal conductivities of the first members 51 and the second members 52 are lower than that of the support plate 20. As a result, the thermal resistance between the recording element substrate 1 and the support plate 20 is higher in the outer peripheral portion of the recording element substrate 1 than in the center portion. In the first embodiment, a thickness d1 of the first members 51 (a length in a direction perpendicular to the discharge port surface 15*a*) is 4 mm, and a thickness d2 of the second members 52 is 1 mm (FIGS. 1C and 1D).

First, a temperature distribution in the L-direction of the recording element substrate 1 in the first embodiment will be described with reference to FIG. 1C. The first members 51 have a thermal conductivity of 0.2 W/mK. In contrast, when the support plate 20 is formed of silicon carbide, it has a thermal conductivity of 160 W/mK.

When recording is performed using the liquid discharging recording head 100 of the first embodiment, heat generated by driving the electrothermal transducers used as the recording elements 13 is promptly transferred to the support plate 20 having high thermal conductivity in the center portion of each recording element substrate 1. In contrast, heat transfer is suppressed in the outer peripheral portion of the recording element substrate 1 where the first members 51 having a thermal conductivity lower than that of the support plate 20 are provided.

Figure 2A:
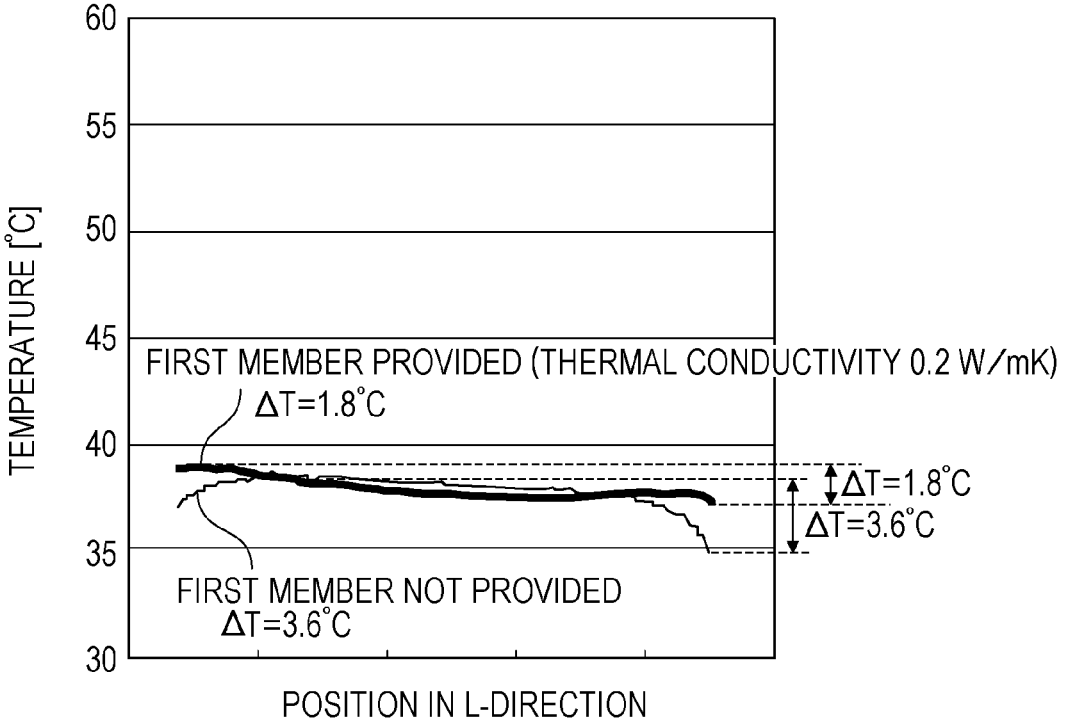
FIG. 2A is a temperature distribution chart in an L-direction of recording element substrates in the first embodiment and a comparative example.

FIG. 2A illustrates temperature distributions in the L-direction of the recording element substrate 1*a* passing through the center portion in the W-direction of the recording element substrate 1*a* after recording in a case in which the first members 51 are provided and a case in which the first members 51 are not provided (comparative example). When the first members 51 are not provided, the temperature decreases at both ends of the recording element substrate 1 in the L-direction, and a temperature difference ΔT between the highest temperature and the lowest temperature is 3.6° C. In contrast, when the first members 51 are provided, the temperature difference ΔT is 1.8° C. By the first members 51, the decrease in temperature is suppressed at both ends of the recording element substrate 1 in the L-direction, and the temperature distribution of the recording element substrate 1*a* in the L-direction is improved.

Figure 2B:
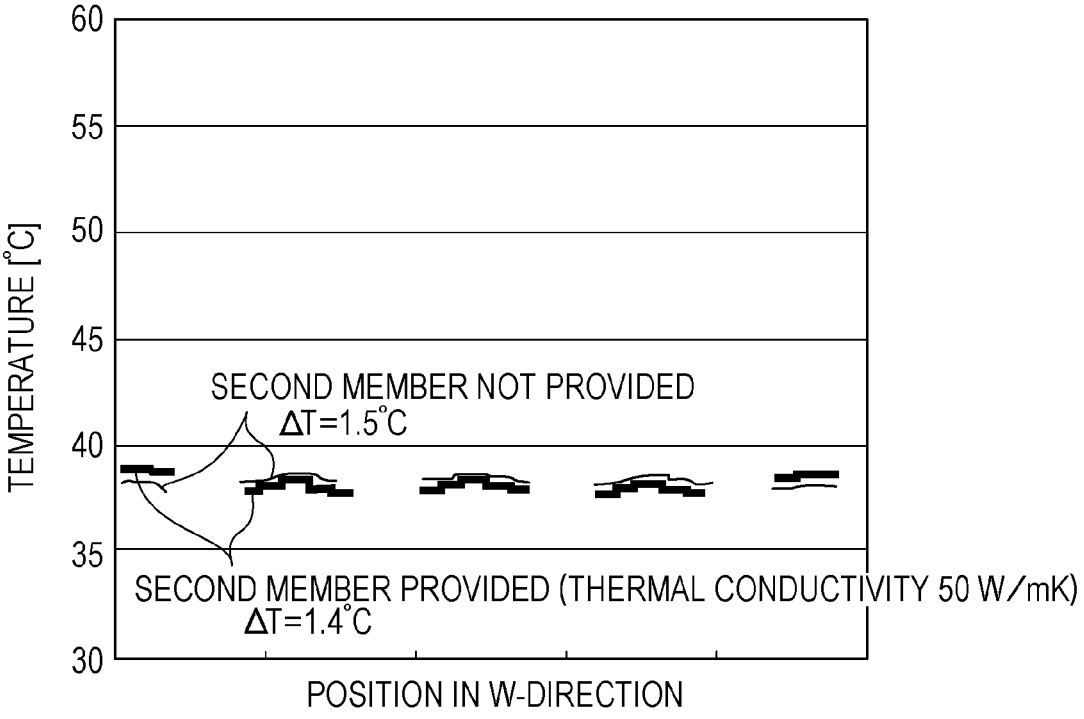
FIG. 2B is a temperature distribution chart in a W-direction of the recording element substrates in the first embodiment and the comparative example.

Next, a temperature distribution of the recording element substrate 1 in the W-direction will be described. The second members 52 have a thermal conductivity of 50 W/mK, which is higher than that of the first members 51. As described above, the thermal conductivity of the support plate 20 is 160 W/mK. FIG. 2B illustrates temperature distributions in the W-direction of the recording element substrate 1*a* passing through the center portion in the L-direction of the recording element substrate 1*a* after recording in a case in which the second members 52 are provided and a case in which the second members 52 are not provided (comparative example). When the second members 52 are not provided, a temperature difference ΔT between the highest temperature and the lowest temperature is 1.5° C. In contrast, when the second members 52 are provided, the temperature difference ΔT is 1.4° C. By the second members 52, the decrease in temperature is suppressed at both ends of the recording element substrate 1 in the W-direction, and the temperature distribution of the recording element substrate 1*a* in the W-direction is improved.

When the second members 52 are formed of a material having a thermal resistance equivalent to that of the first members 51, the temperature increases at both ends of the recording element substrate 1*a* in the W-direction, and the temperature difference ΔT in the W-direction is 19.6° C., which is higher than when the second members 52 are not provided.

As described above, in the first embodiment, the first members 51 support both ends of the recording element substrate 1 in the L-direction. The second members 52 support both ends of the recording element substrate 1 in the W-direction and have a thermal conductivity higher than that of the first members 51. This reduces the influence of the temperature difference between the outer peripheral portion and the center portion in the directions, and improves the in-plane temperature distribution of the recording element substrate 1. As a result, a high-quality image can be obtained with reduced unevenness in density. While the thermal conductivities of the first members 51 and the second members 52 are different in the first embodiment, it is satisfactory as long as the thermal resistance of the second members 52 is lower than that of the first members 51.

In the first embodiment, four vertexes of the recording element substrate 1 at intersections of the sides 16 and the sides 17 are supported by the first members 51. Since heat is easily radiated at the vertexes in the plane of the recording element substrate 1, the vertexes are supported not by the second members 52, but by the first members 51 having a lower thermal conductivity. This can further improve the in-plane temperature distribution of the recording element substrate 1.

In the first embodiment, the first members 51 are formed of a resin material. The second members 52 are formed of a resin material containing a highly thermal conductive filler, and the thermal conductivity of the second members 52 can be adjusted by the amount of filler. Specifically, modified-Polyphenyleneether or polyphenylene sulfide can be used as the resin material. The material is not limited thereto, and a material having a proper thermal conductivity can be selected.

The thermal conductivities of the first members 51 and the second members 52 in the first embodiment are just exemplary, and an optimal combination of thermal conductivities can be selected according to the material of the support plate 20 and the size, structure and input energy of the recording element substrate 1.

While the thermal conductivities of two opposing sides are equally set in the first embodiment, they may be different from each other. In this case, the temperature distribution is sometimes further improved depending on the structure of the liquid discharging recording head 100.

While the full-line liquid discharging recording head 100 is adopted in the first embodiment, the present disclosure is also applicable to a head that performs recording by scanning the liquid discharging recording head 100 in a reciprocating manner.

Second Embodiment

Next, a liquid discharging recording head 100 according to a second embodiment of the present disclosure will be described.

While the liquid discharging recording head 100 of the second embodiment is substantially similar in structure to the above-described liquid discharging recording head 100 of the first embodiment illustrated in FIG. 1, it is different in that the thermal conductivity of first members 51 differs among recording element substrates 1.

In the first embodiment, the thermal conductivity of the first members 51 and the thermal conductivity of the second members 52 corresponding to the recording element substrate 1*a* are 0.2 W/mK and 50 W/mK, respectively. In contrast, in the second embodiment, the thermal conductivity of the first members 51 is different between a recording element substrate 1*a* and a recording element substrate 1*i* (FIG. 1A). In the second embodiment, the thermal conductivity of the first members 51 corresponding to the recording element substrate 1*a* is 0.2 W/mK, and the thermal conductivity of the first members 51 corresponding to the recording element substrate 1*i* is 20 W/mK.

Figure 3A:
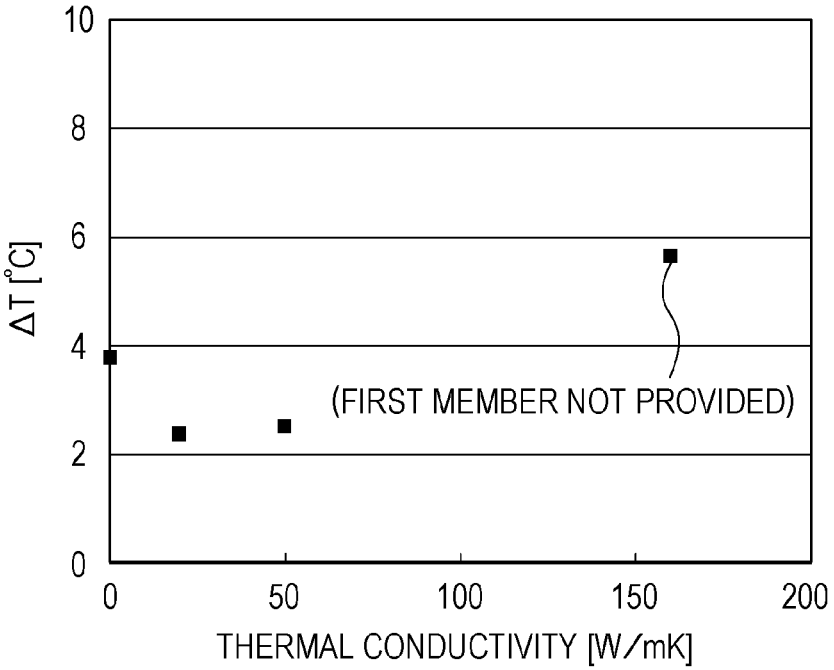
FIG. 3A illustrates the relationship between the thermal conductivity of a first member in a recording element substrate according to a second embodiment and a temperature difference in an L-direction of the recording element substrate.

FIG. 3A illustrates the relationship between the thermal conductivity of the first members 51 and the temperature difference ΔT in the array direction of discharge ports 12 (L-direction) in the recording element substrate 1*i*. The thermal conductivity of the second members 52 is 50 W/mK. FIG. 3A shows that the temperature difference ΔT is the smallest when the thermal conductivity is 20 W/mK in the recording element substrate 1*i*.

A description will be given of the reason why the optimum thermal conductivity differs among the recording element substrates 1. As described above, liquid for recording is first supplied to a recording element substrate 1*a*, and is sequentially supplied to recording element substrates 1*b*, 1*c*, 1*d*, . . . via liquid supply passages 21 and liquid connecting passages 22. Finally, the liquid is supplied to a recording element substrate 1*i*. Heat generated by recording elements 13 is partly transferred to the liquid. Although the heat quantity is small, the heat propagates to the recording element substrates located on the downstream side in the liquid flowing direction through supply of the liquid. Therefore, the liquid to which part of heat generated by the recording element substrates 1*a* to 1*h* is applied is supplied to the recording element substrate 1*i* located on the most downstream side in the flow direction of the liquid supply passages 21. Thus, the transfer rate of generated heat differs between the recording element substrates 1*a* and 1*i*, and the temperature distribution in the recording element substrate 1 also differs therebetween. Hence, it is considered that the optimum thermal conductivity of the first members 51 varies.

Figure 3B:
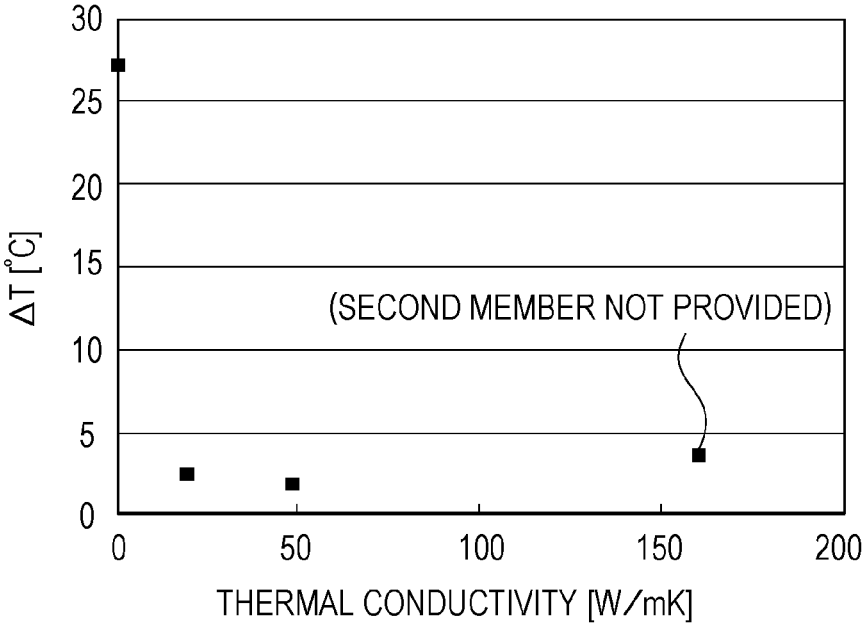
FIG. 3B illustrates the relationship between the thermal conductivity of a second member in the recording element substrate of the second embodiment and a temperature difference in a W-direction of the recording element substrate.

FIG. 3B illustrates the relationship between the thermal conductivity of the second members 52 and the temperature difference ΔT in a direction (W-direction) intersecting the array direction of discharge ports 12 in the recording element substrate 1*i*. The thermal conductivity of the first members 51 is 0.2 W/mK. Similarly to the recording element substrate 1*a*, the temperature difference ΔT in the W-direction is the smallest when the thermal conductivity of the second members 52 is 50 W/mK, and the in-plane temperature distribution of the recording element substrate 1*i* is improved.

As described above, the thermal resistance of the first members 51 corresponding to the recording element substrate 1*a* (first element substrate) is higher than the thermal resistance of the first members 51 corresponding to the recording element substrate 1*i* (second element substrate) that is located on the downstream side of the recording element substrate 1*a* in the flow through the liquid supply passages 21. Thus, in the liquid discharging recording head 100 in which liquid is sequentially supplied to a plurality of recording element substrates 1 from the liquid supply passages 21, the in-plane temperature distribution of each recording element substrate 1 can be eliminated.

While only the recording element substrates 1*a* and 1*i* are described in the second embodiment, the optimum thermal conductivity can be set for the recording element substrates 1*b* to 1*h* in a similar method. The thermal conductivities of both the first members 51 and the second members 52 may be changed, or only one of them may be changed.

Third Embodiment

Next, a liquid discharging recording head 100 according to a third embodiment of the present disclosure will be described with reference to FIGS. 4A and 4B. While the liquid discharging recording head 100 of the third embodiment is substantially similar in structure to the first embodiment, it is different in that thermal conductivities of first members 51 and second members 52 are equally set and thermal resistances are adjusted by changing thicknesses of the first members 51 and the second members 52.

Figure 4A:
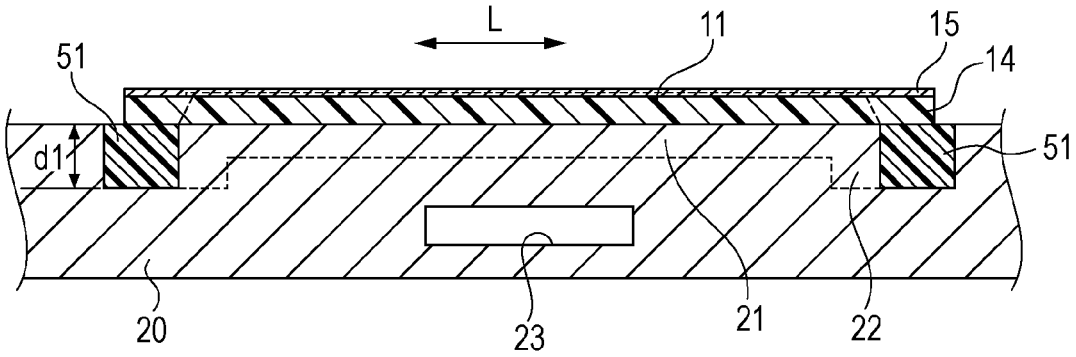
FIG. 4A is a schematic cross-sectional view of a liquid discharging recording head according to a third embodiment, taken along line IC-IC of FIG. 1B.
Figure 4B:
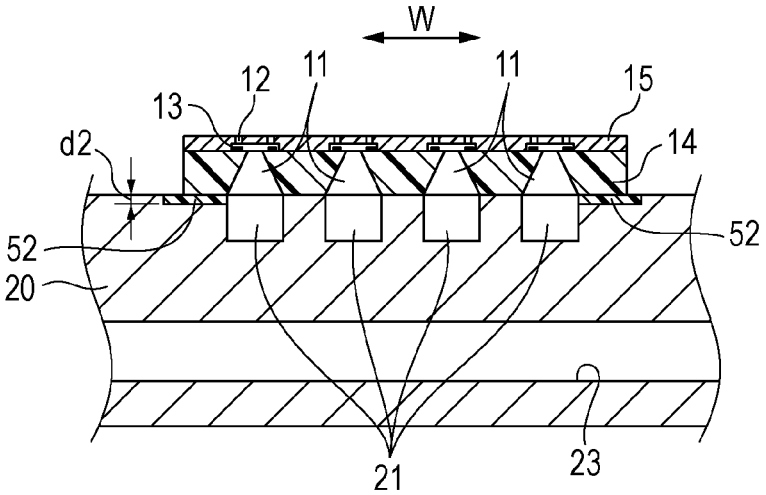
FIG. 4B is a schematic cross-sectional view of the liquid discharging recording head of the third embodiment, taken along line ID-ID of FIG. 1B.
Figure 5A:
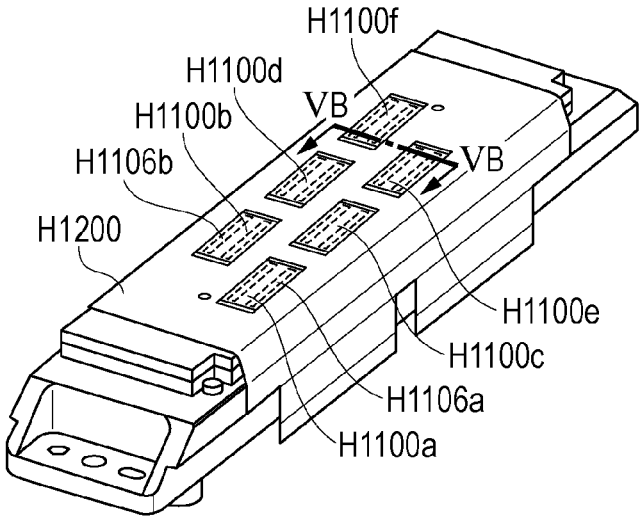
FIG. 5A is a schematic perspective view of a liquid discharging recording head described in Japanese Patent Laid-Open No. 2009-101578.
Figure 5B:
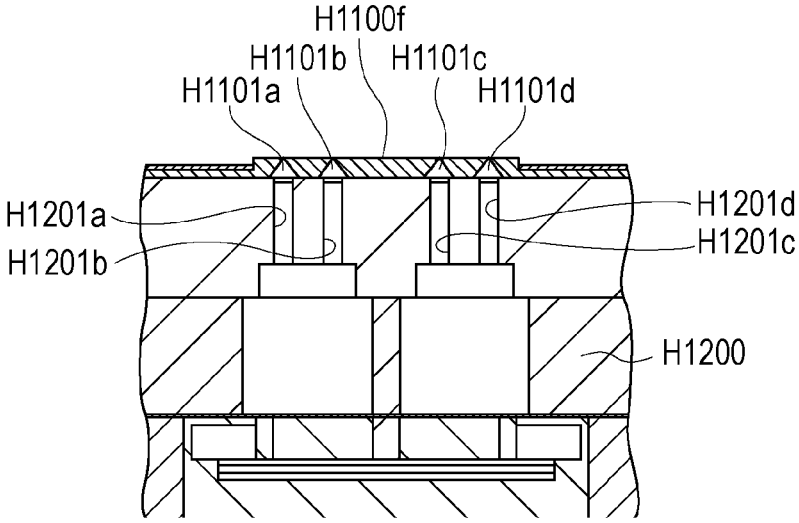
FIG. 5B is a schematic cross-sectional view of the liquid discharging recording head, taken along line VB-VB of FIG. 5A.

FIG. 4A is a schematic cross-sectional of the liquid discharging recording head 100 of the third embodiment, taken along line IC-IC of FIG. 1B, and FIG. 4B is a schematic cross-sectional view of the liquid discharging recording head 100 of the third embodiment, taken along line ID-ID of FIG. 1B. Both FIGS. 4A and 4B illustrate cross sections of a recording element substrate 1*a*.

The first members 51 have the same structure as that adopted in the first embodiment, and have a thermal conductivity of 0.2 W/mK and a thickness d1 of 4 mm. However, the thermal conductivity of the second members 52 is set at 0.2 W/mK, which is equal to that of the first members 51. A thickness d2 of the second members 52 is set at 1/250 of the thickness of the first embodiment, that is, at 4 μm.

While the thermal conductivity of the second members 52 in the recording element substrate 1 is set at 50 W/mK in the first embodiment, it is changed to 0.2 W/mK in the third embodiment. Hence, the thickness of the second members 52 is adjusted to 0.2/50=1/250. Thus, the thermal resistance of the second members 52 in the third embodiment can be set to be equivalent to that of the second members 52 in the first embodiment.

The thickness of the first members 51 corresponding to the recording element substrate 1*i* in the second embodiment can be set in a similar way, and can be adjusted to 0.2/20=1/100, that is, 10 μm, in correspondence to 20 W/mK set in the second embodiment. The first members 51 and the second members 52 that are different in thickness in the third embodiment can be formed of, for example, a resin adhesive material or a resin film member.

The third embodiment can also reduce the influence of the difference in temperature between the outer peripheral portion and the center portion in the directions and improve the in-plane temperature distribution of the recording element substrate 1.

Further, since the first members 51 and the second members 52 can be formed of the same material in the third embodiment, a simpler production process can be expected. Also, since the thermal resistance can be adjusted by the thickness, various materials having different thermal conductivities can be used, and the range of choices for materials is expanded.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-028792 filed Feb. 13, 2012, which is hereby incorporated by reference herein in its entirety.

What is claimed is:

1. A liquid discharging recording head comprising:

an element substrate including a plurality of discharge ports configured to discharge liquid and a plurality of energy generating elements provided to correspond to the plurality of discharge ports to generate energy for discharging the liquid;

a support member configured to support the element substrate;

a first member configured to support an end of the element substrate in an array direction in which the discharge ports are arrayed, the first member having a thermal conductivity less than a thermal conductivity of the support member; and a second member configured to support an end of the element substrate in an intersecting direction, which intersects the array direction, the second member having a thermal conductivity less than the thermal conductivity of the support member and a thermal resistance less than a thermal resistance of the first member, wherein the support member supports a portion of the element substrate except for the end of the element substrate in the array direction and the end of the element substrate in the intersecting direction.

2. The liquid discharging recording head according to claim 1, wherein the first member supports a vertex of the element substrate formed by an intersection of a side of the element substrate supported by the first member and extending in the intersecting direction, and a side of the element substrate supported by the second member and extending in the array direction.

3. The liquid discharging recording head according to claim 1, wherein the support member includes a plurality of supply ports arranged in the array direction to supply the liquid to the element substrate.

4. The liquid discharging recording head according to claim 1, wherein a plurality of the element substrates are arranged in the array direction on the support member, wherein the support member includes a liquid supply passage configured to sequentially supply the liquid to the plurality of the element substrates, wherein the plurality of the element substrates include a first element substrate, and a second element substrate located downstream of the first element substrate in a flow direction of the liquid through the liquid supply passage, and wherein a thermal resistance of the first member configured to support an end of the first element substrate in the array direction is higher than a thermal resistance of the first member configured to support an end of the second element substrate in the array direction.

5. The liquid discharging recording head according to claim 1, wherein the second member has a thermal conductivity greater than the thermal conductivity of the first member.

6. The liquid discharging recording head according to claim 1, wherein a length of the second member in a direction perpendicular to a discharge port surface of the element substrate where the discharge ports are provided is shorter than a length of the first member in the direction.

7. A liquid discharging recording head comprising:

a rectangular element substrate including a plurality of discharge ports configured to discharge liquid and a plurality of energy generating elements provided to correspond to the plurality of discharge ports to generate energy for discharging the liquid;

a support member configured to support at least a central portion of the rectangular element substrate;

a first member configured to support a portion corresponding to a long side of an outer periphery of a bottom of the rectangular element substrate, the first member having a thermal conductivity less than a thermal conductivity of the support member configured to support the central portion of the rectangular element substrate; and a second member configured to support a portion corresponding to a short side of the outer periphery of the bottom of the rectangular element substrate, which intersects the array direction, the second member having a thermal conductivity less than the thermal conductivity of the support member configured to support the central portion of the rectangular element substrate and a thermal resistance less than a thermal resistance of the first member.

8. The liquid discharging recording head according to claim 7, wherein a plurality of rectangular element substrates is formed along a direction in which the plurality of discharge ports is arranged.

9. The liquid discharging recording head according to claim 8, wherein a plurality of rectangular element substrates is formed in a staggered manner in the direction in which the plurality of discharge ports is arranged.

* * * * *